United States Patent [19]

Ackerman

[11] 4,239,280

[45] Dec. 16, 1980

[54] FOLDING SUPPORT CONSTRUCTION

[76] Inventor: Mitchell N. Ackerman, 155 W. 13th St., New York, N.Y. 10011

[21] Appl. No.: 870,920

[22] Filed: Jan. 19, 1978

[51] Int. Cl.[3] ..... A47C 4/00; F16M 11/32

[52] U.S. Cl. ..... 297/18; 248/164; 248/432; 297/441; 297/443

[58] Field of Search ..... 297/18, 31, 29, 441, 297/443; 248/164, 431, 432

[56] References Cited

U.S. PATENT DOCUMENTS

| | | | |
|---|---|---|---|
| 547,778 | 10/1895 | Frantz | 297/18 X |
| 2,203,610 | 6/1940 | Bascom et al. | 297/18 |
| 2,474,597 | 6/1949 | Shwarzowsky | 297/441 |
| 2,992,833 | 7/1961 | Hoedinghouse | 248/164 X |
| 3,122,397 | 2/1964 | Mintz | 248/164 X |
| 3,338,625 | 8/1967 | Jung-Shien | 297/271 X |
| 3,844,612 | 10/1974 | Borggren | 297/441 |
| 3,907,359 | 9/1975 | Joiner | 297/18 |

FOREIGN PATENT DOCUMENTS

| | | | |
|---|---|---|---|
| 120817 | 5/1901 | Fed. Rep. of Germany | 297/18 |
| 621843 | 5/1927 | France | 248/164 |
| 584244 | 10/1958 | Italy | 297/18 |

*Primary Examiner*—James T. McCall

*Attorney, Agent, or Firm*—Blum, Kaplan, Friedman, Silberman & Beran

[57] ABSTRACT

A folding support constructed from arrays of interdigitated elongated members. The interdigitated elongated members are not hinged or joined together in any way, but rather are free to slide with respect to each other. The elongated members are joined to end pieces to form the arrays. A seat extends between the end pieces and rods or flexible members may be used to define the angular position between the arrays.

7 Claims, 14 Drawing Figures

FOLDING SUPPORT CONSTRUCTION

BACKGROUND OF THE INVENTION

This invention relates generally to a folding support and especially to folding supports constructed from arrays of interdigitated elongated members. While a variety of support constructions are known in the art, such constructions when made foldable have required the use of rigid hinges to provide the folding action. The requirement for such hinges has generally limited the variety of embodiments and features which may be constructed. The instant invention is directed to overcoming these limitations.

SUMMARY OF THE INVENTION

Generally speaking, in accordance with the invention, a foldable support construction is provided.

The construction utilizes arrays of spaced elongated members joined at their ends by end pieces. Each panel of the arrays is interdigitated with the other panel so that the elongated members abut one another. However, the interdigitated members are not hinged or joined together so that they are free to slide with respect to one another. Seat means or other support means may extend between the end pieces and flexible or rigid means serve to define the angular positions between the arrays.

Accordingly, it is an object of this invention to provide an improved support construction that is foldable.

Another object of the invention is to provide an improved foldable structure which eliminates the need for hinges.

A further object of this invention is to provide an improved foldable support construction which will not fold when objects are supported thereby.

Yet another object of this invention is to provide an improved support constructed from a number of arrays comprising a plurality of interdigitated elongated members.

Still another object of this invention is to provide an improved support construction which may be utilized to form a number of different support embodiments.

Still other objects and advantages of the invention will in part be obvious and will in part be apparent from the specification.

The invention accordingly comprises the features of construction, combination of elements, and arrangement of parts which will be exemplified in the contruction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
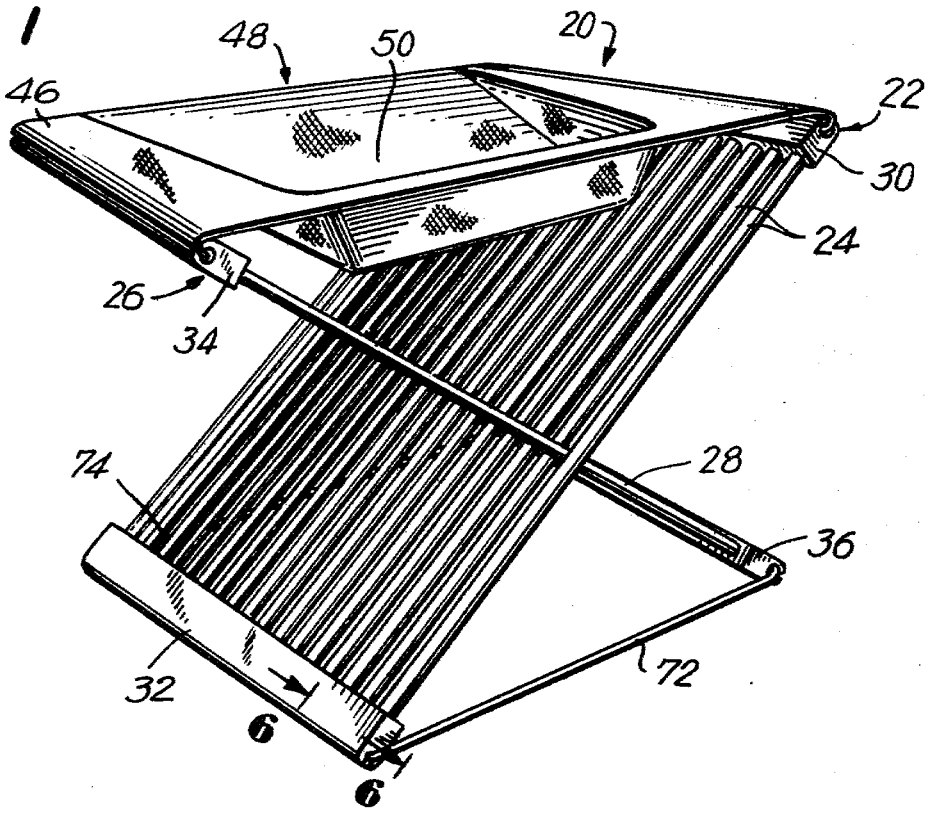
FIG. 1 is a perspective view of a foldable support construction constructed in accordance with a first preferred embodiment of the instant invention.

FIGS. 1-6 illustrate a first preferred embodiment of the instant invention forming a stool 20. Stool 20 is constructed from a first array 22 of elongated members 24 and a second array 26 of elongated members 28. Elongated members 24 and 28 are interdigitated with each other but are not joined together in any manner. Elongated members 24 of array 22 are joined together at their ends by a pair of end pieces 30, 32. Similarly, elongated members 28 of array 26 are joined at their ends by a pair of end pieces 34, 36.

While elongated members 28, 24 are illustrated as circular in cross-section. It is to be understood that members 24, 28 could have any desired cross-section. Elongated members 24, 28 are joined to their respective end pieces 30, 32, 34, 36 by insertion into bores 38, 40, 42, 44 respectively. Elongated members 24, 28 may be secured to bores 38, 40, 42, 44 by any suitable means such as glue or mechanical attachment. Each elongated member 24 is spaced apart on its end pieces 30, 32 a distance equal to the width of elongated member 28 with which it is interdigitated. Similarly, each elongated member 28 is spaced apart on its end pieces 34, 36 a distance equal to that of the width of elongated member 24 with which it is interdigitated. This spacing permits each elongated member to abut the elongated members with which it is interdigitated.

Figure 5:
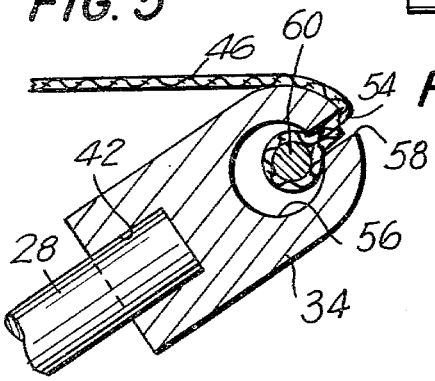

Flexible material 46 forms a seat 48 and may include a recessed portion 50 to receive a person. Seat 48 extends between end pieces 30 and 34 as shown in FIG. 5, the outer lateral edges of material 46 are formed into loops 52, 54. End piece 34 includes a circular opening 56 and a narrow slot 58 through which loop 54 may be inserted, after loop 54 is inserted into opening 56 through slot 58 a dowel 60 is inserted into loop 58 to secure seat 48 to end piece 34. Similarly, end piece 30 includes an opening 62 and a slot 64 for insertion of loop 52 after which a dowel 66 is inserted to secure seat 48 to end piece 30. Of course, any other form of attachment of seat 48 to end pieces 30, 34 may also be used.

Figure 2:
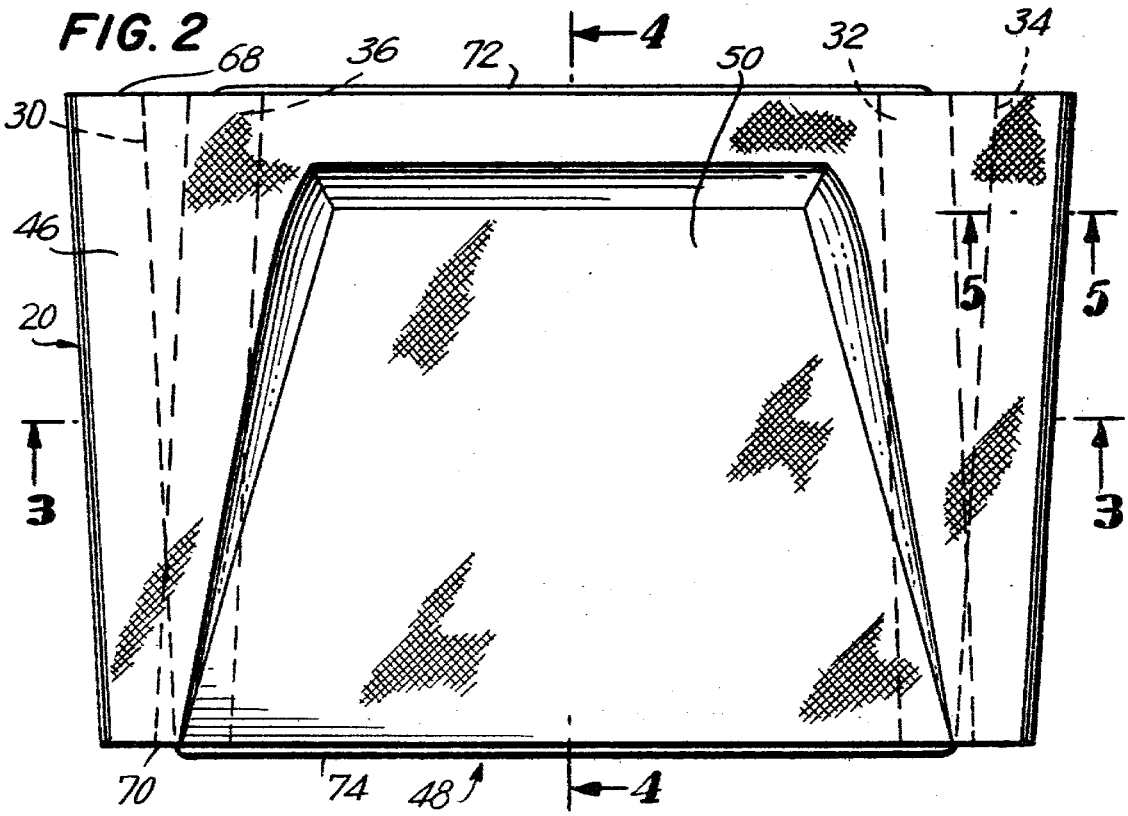
FIG. 2 is a top plan view of a foldable support construction constructed in accordance with the first embodiment of the instant invention.
Figure 3:
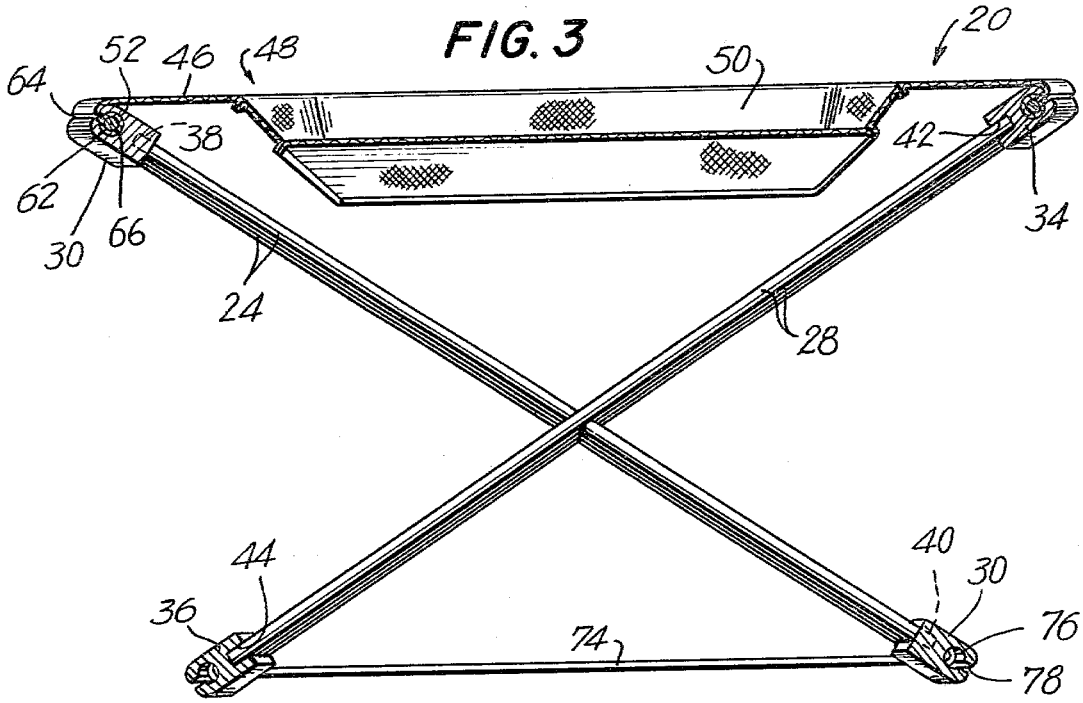
FIG. 3, FIG. 4 and FIG. 5 are sectional views taken along lines 3—3, 4—4 and 5—5 respectively of FIG. 2.
Figure 4:
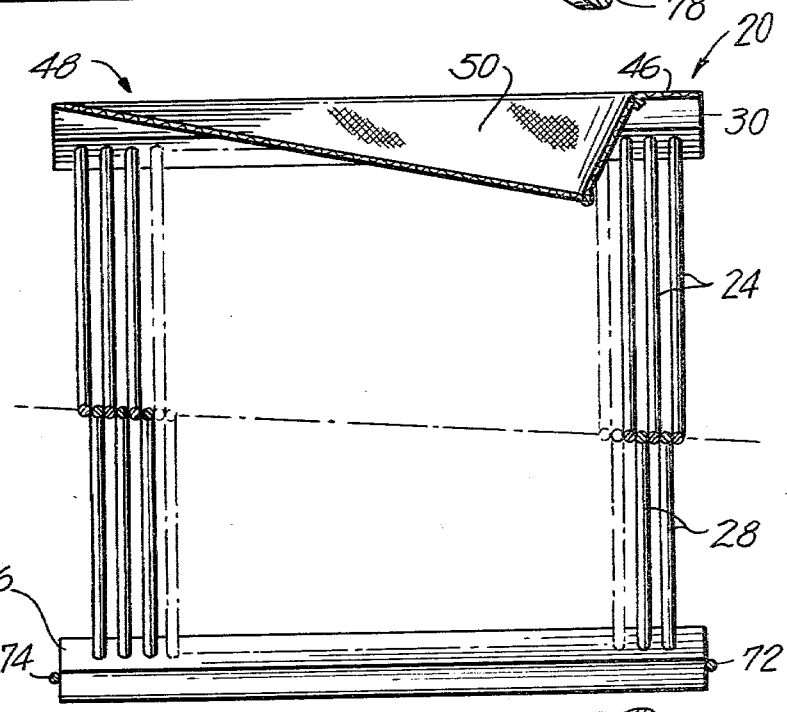

As is seen in FIG. 2 the rearward edge 68 of seat 48 is longer than that of its forward edge 70 forming a trapezoidal shaped seat 48. This trapezoidal arrangement, as will be described below, confers unique advantages to this construction.

End pieces 32 and 36 form the base on which the stool rests. A connecting cord 72 extends between end pieces 32 and 36 at their rearmost edge. A connecting cord 74 extends along the forward edge of end pieces 32 and 36. Connecting cords 72, 74 form a connecting member between end pieces 32, 36 and serve to define the angle between arrays 22, 26. Lengthening or shortening the connecting cords will change the angle between arrays 22, 26. Connecting cord 72 is shorter than that of connecting cord 74, so that the periphery of end pieces 32 and 36 and connecting cords 72 and 74 is also in the form of a trapezoid. However, the longest side of the trapezoid formed by connecting cord 74 is along the forward edge of stool 20. While the longest edge 68 of seat 50 is at the rear of stool 20, so that the trapezoids formed by the seat and the base are oppositely orientated. This opposite orientation so distributes the weight of an object or a person supported by seat 48 that arrays 22 and 26 will not close about the object or person in seat 48. This arrangement provides additional comfort and provides stability to the entire support.

Figure 6:
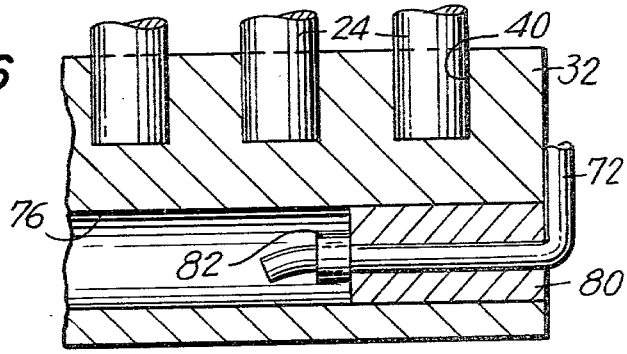
FIG. 6 is a partial sectional view taken along line 6—6 of FIG. 1.
Figure 7:
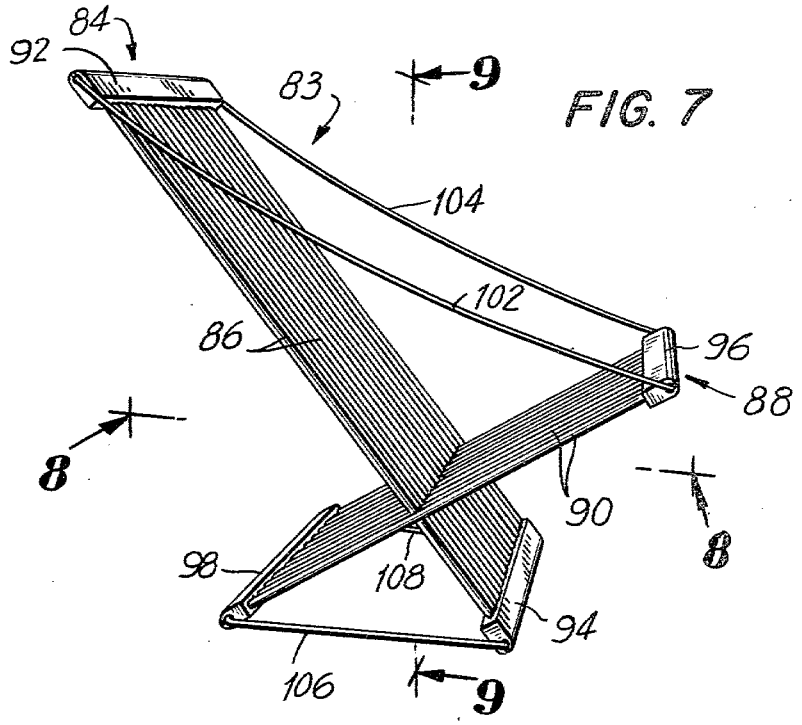
FIG. 7 is a perspective view of a folding support construction in accordance with a second preferred embodiment of the instant invention.
Figure 8:
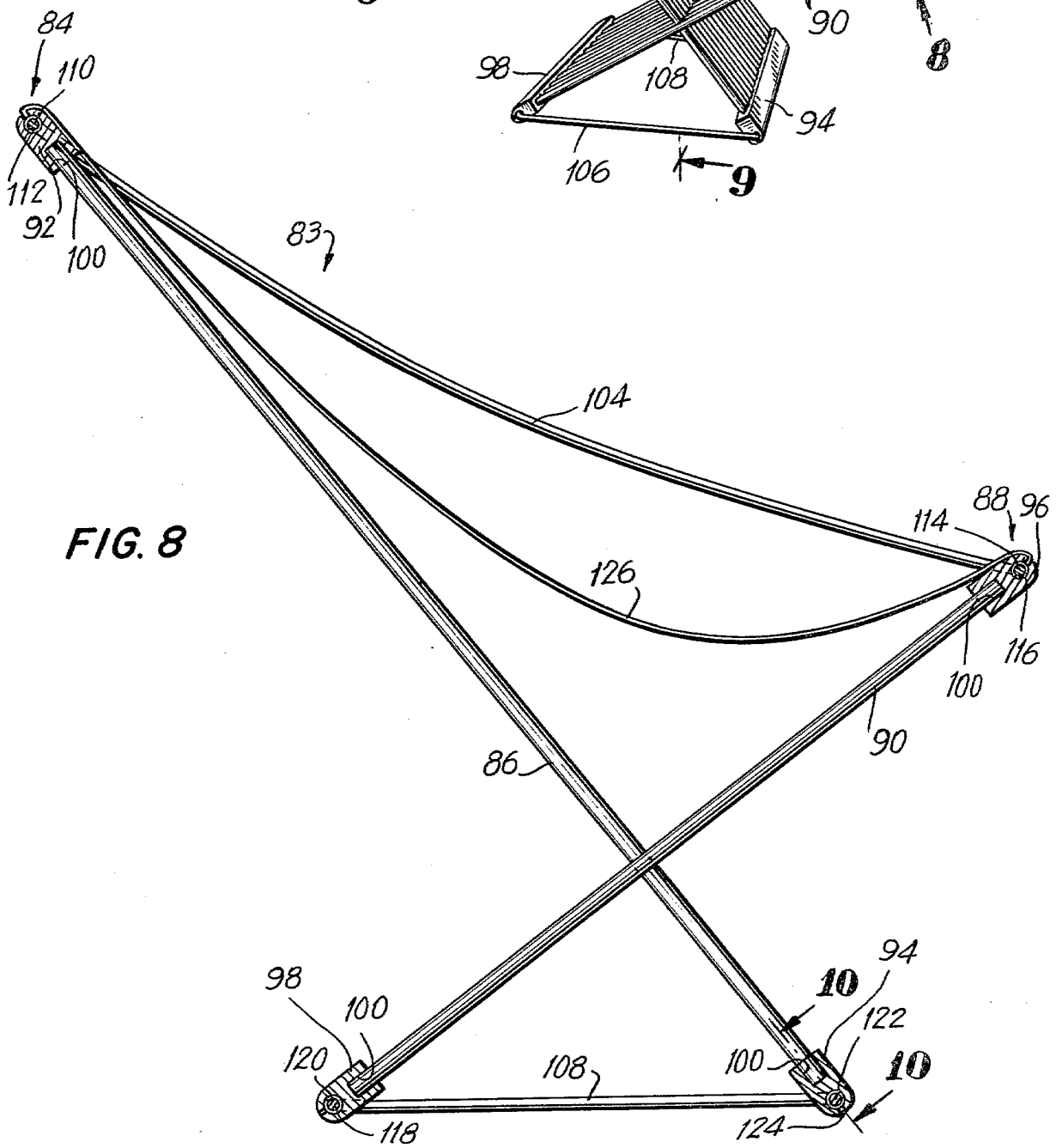
FIGS. 8 and 9 are sectional views taken along line 8—8 and 9—9 respectively of FIG. 7.
Figure 9:
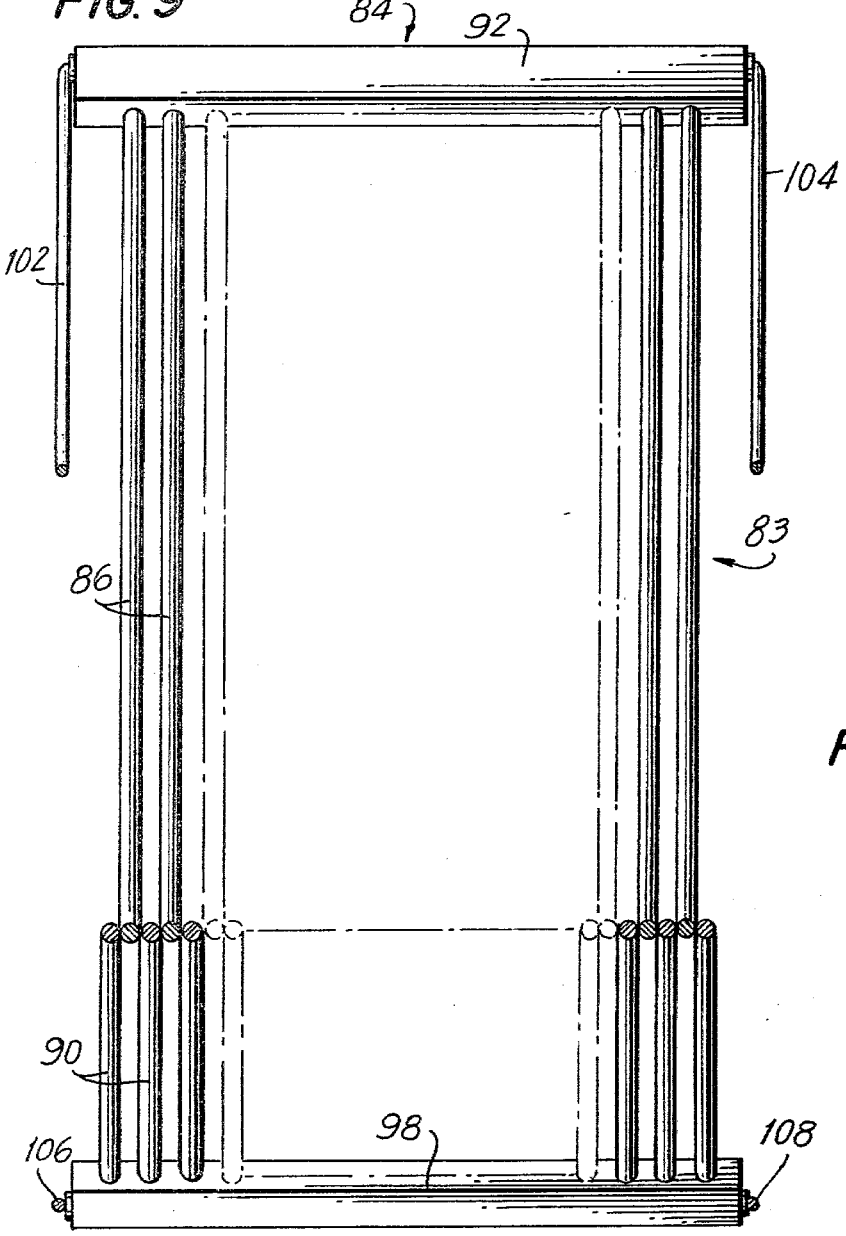

As shown in FIG. 6, end pieces 32 and 36 include a bore 76, a sleeve 80 is disposed in bore 76 and connecting cords 72 and 74 have an enlarged portion 82 which abuts sleeve 80 to secure connecting cords 72 and 74 to end pieces 32 and 36.

The construction as above described permits stool 20 to be folded for storage and transportation. Elongated members 24, 28 and end pieces 30, 32, 34 36 may be constructed from a variety of materials such as metal, plastic, wood, etc.

FIGS. 7–11 illustrate a second preferred embodiment of the instant invention forming a reclining chair generally indicated at 83. Reclining chair 83 is formed of a first array 84 of elongated members 86 and a second array 88 of elongated members 90. In this embodiment the elongated members 86 of array 84 are longer than that of the elongated members 90 of array 88. Each array 84, 88 is constructed similarly to arrays 22, 24 of the first embodiment. Elongated members 86 are joined at their ends to an upper end piece 92 and a lower end piece 94. Similarly, elongated members 90 extend between an upper end piece 96 and a lower end piece 98. Elongated members 90 and 86 are inserted into bores 100 which are spaced apart the width of the elongated member with which they are interdigitated, as previously described with respect to the first embodiment. Again, elongated members 90, 86 are free to slide with respect to each other since they are in no way joined together.

Rigid connecting rods 102 and 104 extend between end pieces 92 and 96. Similarly, connecting rods 106 and 108 extend between end pieces 94 and 98. Connecting rods 102, 104, 106, 108 serve to define the angle between arrays 84 and 88.

Connecting rods 102 and 104 may be formed from a single rod by bending so as to form a first transverse rod 110 which is releasably secured in a slot 112 disposed in end piece 84 and a second transverse rod 114 releasably securable in a slot 116 provided in end piece 96. Similarly, connecting rods 106 and 108 may be formed from a single rod and include a transverse rod 118 which is releasably securable to a slot 120 disposed in end piece 98 and a second transverse rod 122 is releasably securable in a slot 124 disposed in end piece 94. A sleeve 125 located at the bends forming transverse rods 110, 114, 118 and 122 serves to releasably secure them to their respective slots 112, 116, 120, 124.

In use, a seat 126 formed of any suitable flexible material is joined to end pieces 92 and 96. The fact that the elongated members of each array 84, 88 are free to slide with respect to each other allows the reclining chair 83 to perform a rocking like motion when a person seated in the chair rocks back and forth.

Figure 11:
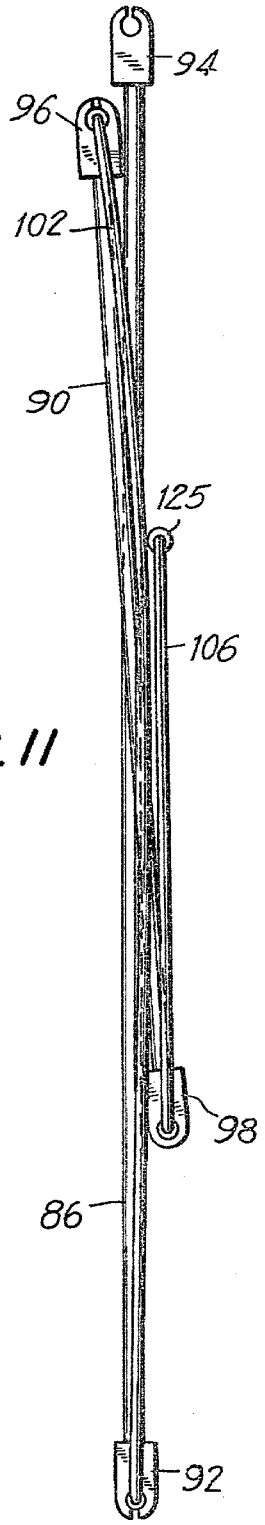
FIG. 11 is a side elevational view of the construction of the second preferred embodiment in its folded state.
Figure 10:
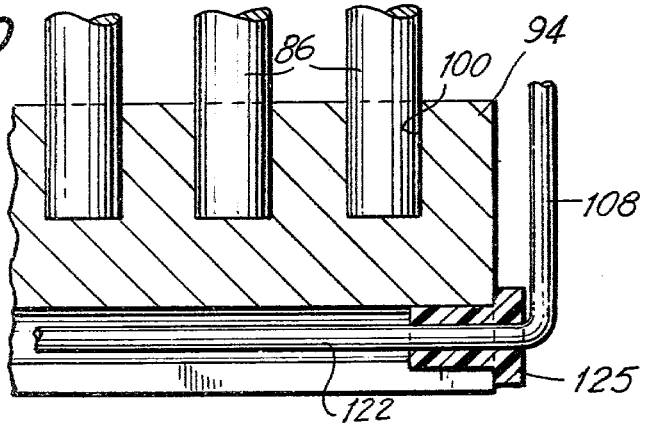
FIG. 10 is a partial sectional view taken along line 10—10 of FIG. 8.

While transverse rods 110, 114, 118 and 122 have been shown as releasably securable only one rod need be disengaged with its respective slots 112, 116, 120, 124 in order for the assembly to be folded. After such disengagement the second embodiment of the instant invention may be folded as shown in FIG. 11.

While connecting rods 102, 104, 106 and 107 have been illustrated as solid rods they could be replaced by flexible connecting cords as shown in the first embodiment. Similarly, the flexible connecting cords 72, 74 of the first embodiment could be replaced by rigid rods. Such rigid rods would, of course, have to be releasably engageable with end pieces 32, 36 in order to fold the stool.

Figure 12:
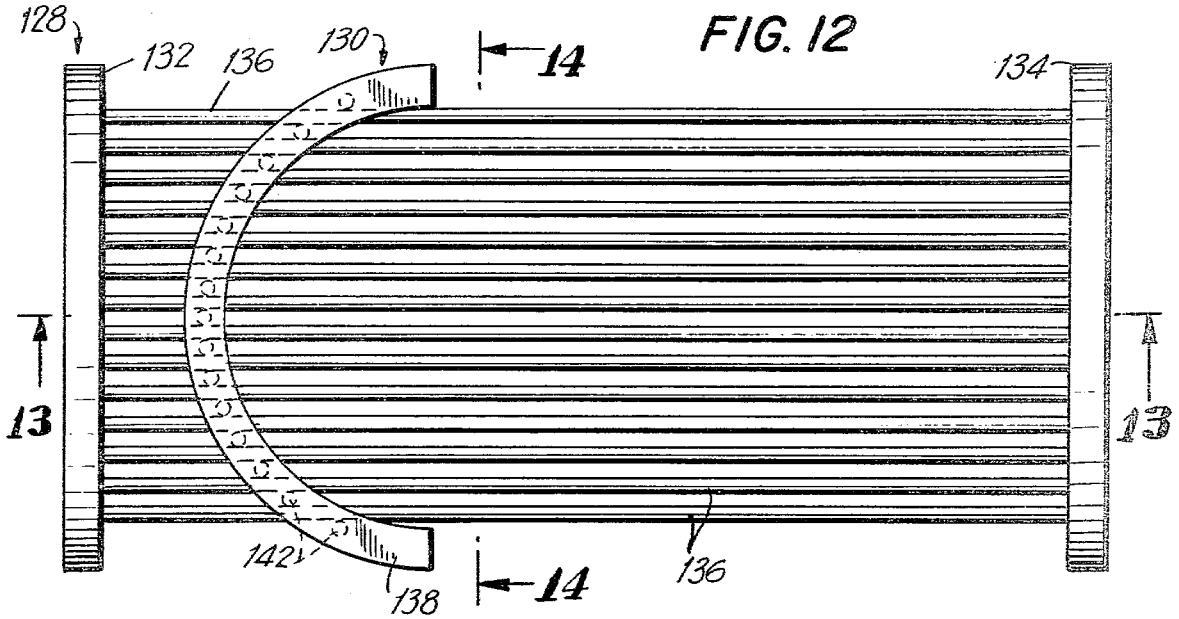
FIG. 12 is a top plan view of a folding support construction in accordance with a third preferred embodiment of the instant invention.
Figure 13:
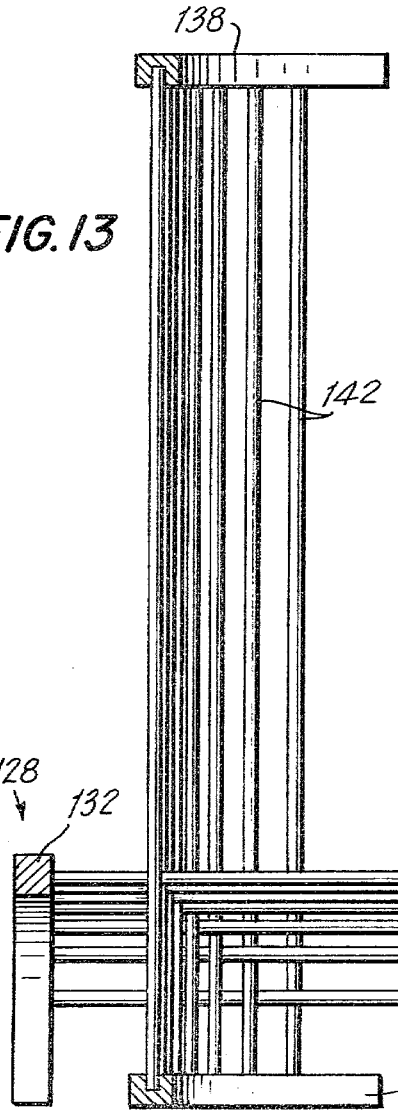
FIG. 13 is a side elevational view of the construction of the third preferred embodiment.
Figure 14:
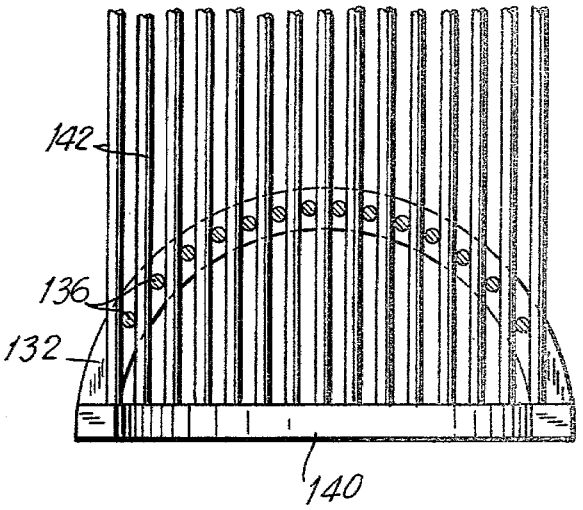
FIG. 14 is a partial sectional view taken along line 14—14 of FIG. 12.

FIGS. 12–14 illustrate yet another embodiment of the instant invention which may be used to form a variety of supports. In this embodiment a first array 128 is interdigitated with a second array 130. Array 128 is composed of a pair of curved end pieces 132, 134 with elongated members 136 extending therebetween. Similarly, array 130 is formed of curved end pieces 138, 140 with elongated members 142 extending therebetween.

As shown in FIG. 14 elongated members 142 are interdigitated with elongated members 136 so that each elongated member 136 abuts a pair of elongated members 142. Note that the spacing between elongated members 136 along end pieces 132 and 134 must be varied, with the closest spacing between the centermost members because of the curved configuration of the end pieces 132, 134. However, the spacing when measured along a straight line is of course equidistant. The curved array as shown in FIGS. 12–14 permits a variety of support constructions to be constructed. Such curved arrays may be utilized with other curved arrays or with straight arrays. Furthermore, such curved arrays can be used to form a curved seat back to replace the back formed by array 84 of the second embodiment. Additionally, the seat portion may also be curved with the use of curved end pieces to replace end pieces 92 and 96.

As noted with respect to the first embodiment, the elongated members and end pieces of the second and third embodiments may be constructed from any suitable material such as wood, plastic, metal, etc. Furthermore, the dowels themselves may also be curved.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A folding support comprising first and second arrays, said arrays including a pair of end pieces and elongated members extending between and joined to said end pieces, the members of said first array being interdigitated with the members of said second array, said interdigitated members being free to slide with respect to each other, object supporting means joined to one end piece of each said first and second arrays and means for defining the angle between each said array, said end pieces being positioned non-parallel to each other by said angle defining means.

2. The folding support as claimed in claim 1, wherein said object supporting means includes a forward and a rearward edge, said rearward edge of said object supporting means being longer than said forward edge, and wherein said angle defining means comprise connecting means joining the end pieces not joined by said supporting means, said connecting means being of unequal length, said shorter connecting means being disposed along the rearward edge of said supporting means and said longer connecting means being disposed along the forward edge of said supporting means.

3. The folding support as claimed in claim 1, wherein said angle defining means comprise flexible connecting means joined to one end piece of said first array and one of said end pieces of said second array.

4. The folding support as claimed in claim 1, wherein said elongated members of said first array are longer than said elongated members of said second array.

5. The folding support as claimed in claim 4, wherein said elongated members of said first array form the support for the back of a chair.

6. The folding support as claimed in claim 1, wherein said angle defining means comprise rigid connecting means joining one of said end pieces of said first array to one of said end pieces of said second array.

7. A folding support comprising first and second arrays, said arrays including a pair of end pieces and elongated members extending between and joined to said end pieces, the members of said first array being interdigitated with the members of said second array, said interdigitated members being free to slide with respect to each other, said interdigitated members being evenly spaced laterally and in contact with the adjacent elongated members, object supporting means joined to one end piece of each said first and second array and means for defining the angle between each said array, said end pieces being positioned nonparallel to each other by said angle defining means.

* * * * *